United States Patent [19]

Miller et al.

[11] Patent Number: 4,736,915

[45] Date of Patent: Apr. 12, 1988

[54] COMBINATION WASTEBASKET AND STORAGE SHELF ON A ROTATABLE PLATFORM

[75] Inventors: David C. Miller, Ridgefield; Thomas J. Pendleton, Danbury, both of Conn.

[73] Assignee: Mobil Oil Corporation, New York, N.Y.

[21] Appl. No.: 14

[22] Filed: Jan. 2, 1987

[51] Int. Cl.[4] ..... A47F 5/02

[52] U.S. Cl. ..... 248/131; 108/26; 108/50; 220/1 T; 248/DIG. 7; 312/305; D34/5

[58] Field of Search ..... 248/131, 128, 349, DIG. 7; 312/305, 252, 135, 238; 108/25, 26, 50; 220/1 T; D34/1, 5, 6

[56] References Cited

U.S. PATENT DOCUMENTS

| | | | |
|---|---|---|---|
| D. 154,408 | 7/1949 | McGraw | D34/1 |
| D. 229,473 | 12/1973 | Henry | D34/1 |
| 669,736 | 3/1901 | Smith | 312/305 |
| 1,550,043 | 8/1925 | Pearson | 248/DIG. 7 X |
| 1,888,127 | 11/1932 | Hearne | D34/6 X |
| 2,321,981 | 6/1943 | Bowers | 248/DIG. 7 X |
| 3,401,650 | 9/1968 | Terezas | 108/50 X |
| 4,483,440 | 11/1984 | Ware | 206/233 |

FOREIGN PATENT DOCUMENTS

| | | | |
|---|---|---|---|
| 127569 | 3/1947 | Australia | 312/135 |

*Primary Examiner*—J. Franklin Foss
*Assistant Examiner*—David L. Talbott
*Attorney, Agent, or Firm*—Alexander J. McKillop; Michael G. Gilman; James P. O'Sullivan, Sr.

[57] ABSTRACT

A wastebasket and storage shelf combination including a rotatable planar support member carrying a removable wastebasket and a height-adjustable shelf member both kept in position by cooperative association with a vertical wall member.

5 Claims, 3 Drawing Sheets

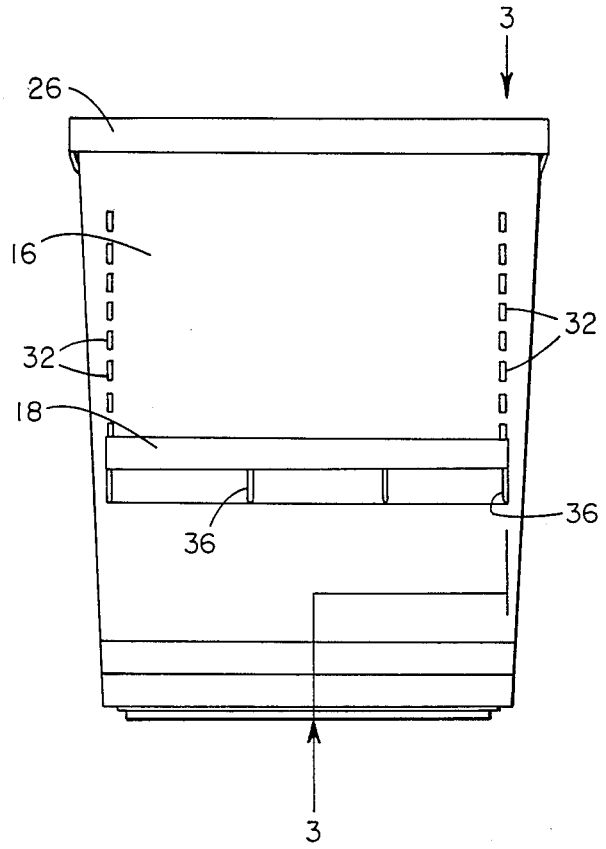
FIG. 3
FIG. 6
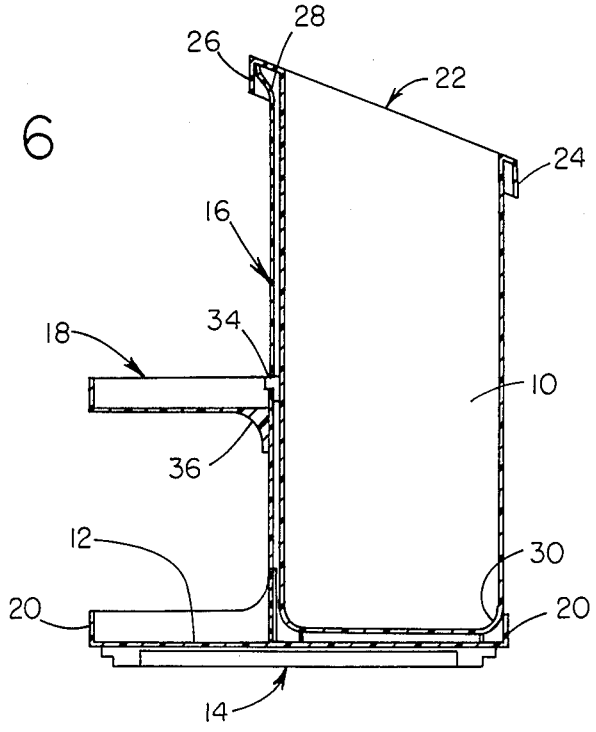

COMBINATION WASTEBASKET AND STORAGE SHELF ON A ROTATABLE PLATFORM

BACKGROUND OF THE INVENTION

This invention generally pertains to a combination wastebasket and storage shelf combination on a rotatable platform.

Many present day kitchens are designed with a cabinet enclosure having doors located about and beneath the base of the kitchen sink region. The region within the enclosure is ideally suited for the storage of various cleaning materials and implements. This region also is ideally suited for an out-of-the-way location for waste containers. It appears, however, that the accommodation of this space for both purposes is not easily accomplished. It would be an important and effective organizational advantage if a device were available for both the storage of cleaning materials, including waste bags, and also for the location of a waste container to be employed with a thin gauge liner bag.

The invention disclosed herein does ideally satisfy both needs.

SUMMARY OF THE INVENTION

The present invention is a wastebasket and storge shelf combination comprising:

a rotatable planar support member carrying a wastebasket on one area thereof and at least one shelf member on an adjacent area thereof;

a vertical wall member carried by said support member located betwen said wastebasket and said shelf;

means in association with said wall member and shelf to height-adjustably fix said shelf to said wall member; and means in association with said wall and wastebasket to removably anchor said wastebasket to said platform.

The shelf is removably and height-adjustably connected to the vertical wall by means of a pair of spaced appendages protruding from the end regions of the shelf and a pair of spaced apart, vertically aligned series of orifaces in said wall are located so that a selected pair of spaced orifaces can receive the pair of appendages at a selected height.

In addition, the shelf is cantilever-supported from the vertical wall by means of at least a pair of spaced apart angle support brackets each having a leg extending beneath the shelf and another leg thereof in contacting parallel relationship to the wall.

The rotatable planar support member has either a polygonal or curved perimeter and a short upwardly extending fence following about said perimeter.

The wastebasket has a flat rear wall connected to a curved front wall, a bottom wall having a perimeter defined by the rear and front walls and an open mouthed top. The top has an outwardly overfolded perimeter adapted at the rear to releasably capture the top of the vertical wall member. The wastebasket is removably located between the bottom of the vertical wall member and a segment of the fence and can be removed by first lifting the basket from the top of the vertical wall member. In a preferred embodiment, the open mouth top is inclined upwardly from the curved front wall to the flat rear wall of the wastebasket.

BRIEF DESCRIPTION OF THE DRAWINGS

FIG. 3 is a rear view of the assembly of FIG. 1;

FIG. 6 is a side view in section taken along the lines 3—3 of FIG. 3.

DETAILED DESCRIPTION OF THE INVENTION

Figure 1:
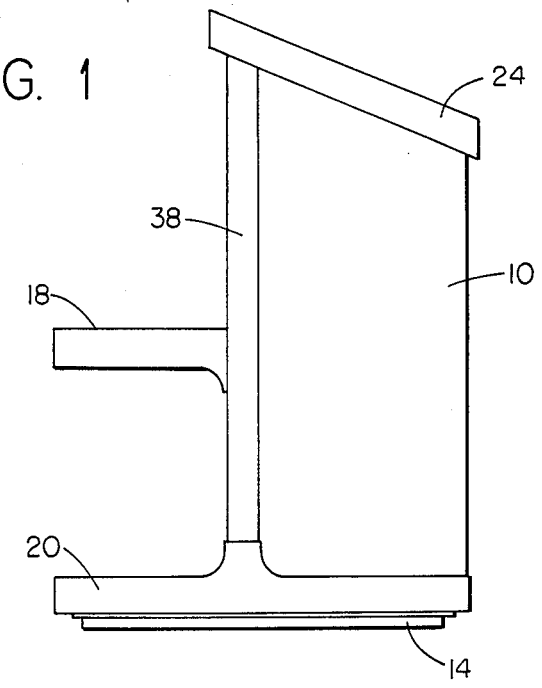
FIG. 1 is a side view of the assembled combination wastebasket and storage shelf on a rotatable platform.

The drawings depict a fully assembled combination of a wastebasket 10, a platform 12, see FIG. 6, on a rotatable turntable 14, a vertical wall 16, and a height-adjustable shelf 18. About the perimeter of rotatable platform 12 is a short fence 20. Vertical wall 16 is affixed to rotatable platform 12 by any suitable means, for example, a peg and hole arrangement molded into the respective parts or by the use of anchor screws or anchor nuts and bolts. At the open mouth portion 22 of wastebasket 10 the complete peripheral rim is overfolded as shown at 24 and 26 so that it is in a downwardly depending attitude. This configuration can be conveniently molded into the perimeter of the wastebasket during manufacture. FIGS. 3 and 6 show the straight rearward most region of the perimeter of the waste container mouth positioned over the top edge portion of vertical wall 16 at offset portion 28. This arrangement permits the overfold region of the wastebasket to capture the top of vertical wall 16 all along region 28. In cooperation with this arrangement, bottom front region 30 of wastebasket 10 is positioned behind the front segment of fence 20 so as to keep the wastebasket firmly in position on platform 12 during rotation and use of the assembly. The wastebasket is removed merely by lifting the wastebasket 10 directly up free of the upper region 28 of vertical wall 16 so that bottom front region 30 of the wastebasket clears the front region of the platform fence 20.

FIG. 3 shows the rear of the assembly wherein vertical wall 16 has a pair of spaced lines of orifaces 32 to accommodate the height adjustment of shelf 18. On the inside ends of shelf 18, as shown in FIG. 6, preferably as an integral part thereof, are molded L-shape appendages 34 adapted to be received through two of the spaced orifices 32. To further support shelf 18 on the underside thereof, again, perferably as an integral part thereof, are cantilever support members 36. These are spaced-apart, angle support brackets each having a leg extending beneath the shelf and another leg thereof in contacting parallel relationship to the wall. These members in combination with spaced appendages 34 provide adequate support for shelf 18.

Vertical wall 16 can have flange members 38 at opposite sides thereof. These flanges can be integrally molded members or separately attached flange members. They serve to positively locate and keep the wastebasket in position on the rotatable platform.

Figure 2:
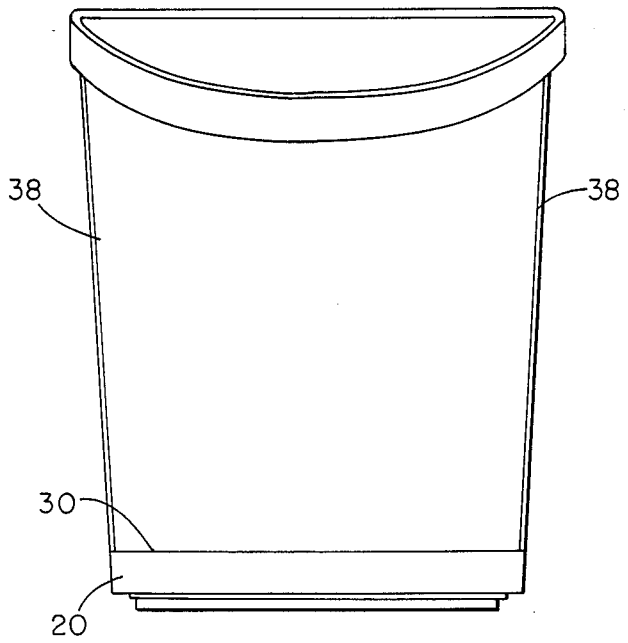
FIG. 2 is a front view of the assembly of FIG. 1.
Figure 4:
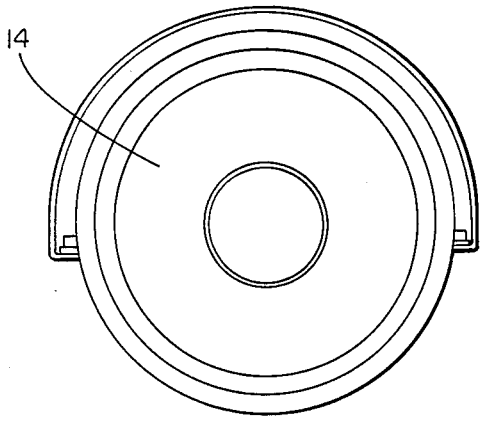
FIG. 4 is a rear view of the assembly of FIG. 1.
Figure 5:
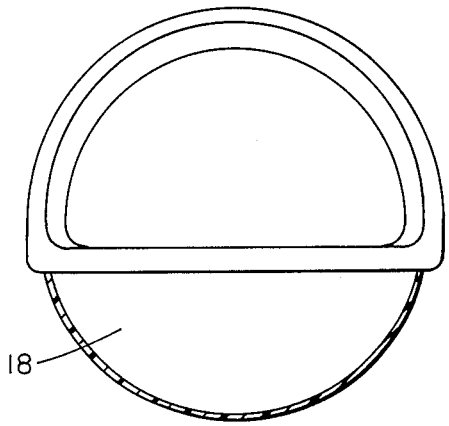
FIG. 5 is a top view of the assembly of FIG. 1.

The open mouth of the container is inclined upwardly from front to rear, as shown in FIGS. 1, 2 and 6, so as to provide easy access to the waste container when it is positioned in its intended location beneath a kitchen sink.

The combination is designed for easy yet permanent assembly by no more than four pegs or fasteners to maintain the vertical wall in position.

The combination can be made of any material, perferably of a thermoplastic polymer. Useful thermoplastic polymers include the polyolefins, polyvinyl chlorides, etc. Particularly preferred are various polyethylenes readily commercially available.

Various changes and modifications within the scope and spirit of this invention will occur to those skilled in the art. Therefore, applicants intend to be bound only by the claims which follow.

We claim:

1. A wastebasket and storge shelf combination for use in an under-the-sink enclosure comprising: a rotatable planar support member carrying a wastebasket on one area thereof and at least one shelf member on an adjacent area thereof;

a vertical wall member carried by said support member between said wastebasket and said shelf, means in association with said wall member and shelf to height-adjustably fix said shelf to said wall member;

said wastebasket having a flat rear wall connected to a curved front wall, a bottom wall having a perimeter defined by said rear and front walls and an open mouth top, said top having an outwardly overfolded perimeter adapted at the rear to releasably capture the top of said vertical wall member, said wastebasket being removably located on said planar support so as to capture the top of said vertical wall member.

2. The combination of claim 1 wherein said shelf is removably and height-adjustably connected to said vertical wall by means of a pair of spaced appendages protruding from the end regions of said shelf and a pair of spaced apart, vertically aligned series of orifaces in said wall, located so that a selected pair of spaced orifaces receive said pair of appendages at a selected height.

3. The combination of claim 2 wherein said shelf is also cantilever-supported from said vertical wall by means of at least a pair of spaced apart angle support brackets, each having a leg extending beneath said shelf and another leg in contacting parallel relationship to said wall.

4. The combination of claim 1 wherein said rotatable planar support member has either a polygonal or curved perimeter and a short fence following about said perimeter.

5. The combination of claim 1 wherein said open mouth top is inclined upwardly from said curved front wall to said flat rear wall.

* * * * *